US005593290A

United States Patent [19]

Greisch et al.

[11] Patent Number: 5,593,290

[45] Date of Patent: Jan. 14, 1997

[54] MICRO DISPENSING POSITIVE DISPLACEMENT PUMP

[75] Inventors: Danny L. Greisch, Hilton; John B. Chemelli, Webster, both of N.Y.

[73] Assignee: Eastman Kodak Company, Rochester, N.Y.

[21] Appl. No.: 362,367

[22] Filed: Dec. 22, 1994

[51] Int. Cl.[6] ..... F04B 43/05

[52] U.S. Cl. ..... 417/478; 417/479

[58] Field of Search ..... 417/478, 479, 417/480, 474, 510, 475, 395

[56] References Cited

U.S. PATENT DOCUMENTS

| | | | |
|---|---|---|---|
| 2,980,032 | 4/1961 | Schneider . | |
| 3,007,416 | 11/1961 | Childs . | |
| 3,148,624 | 9/1964 | Baldwin . | |
| 3,250,224 | 5/1966 | Phillips et al. . | |
| 4,025,121 | 5/1977 | Kleysteuber et al. | 417/478 X |
| 4,158,530 | 6/1979 | Bernstein | 417/389 |
| 4,236,880 | 12/1980 | Archibald | 417/478 |
| 4,303,376 | 12/1981 | Siekmann | 417/360 |
| 4,836,756 | 6/1989 | Fukumoto | 417/395 X |
| 4,840,542 | 6/1989 | Abbott | 417/479 X |
| 4,983,102 | 1/1991 | Swain | 417/394 |
| 4,990,062 | 2/1991 | Swank | 417/395 X |
| 5,131,816 | 7/1992 | Brown et al. | 417/478 X |
| 5,252,044 | 10/1993 | Raines et al. | 417/479 |
| 5,405,252 | 4/1995 | Nikkanen | 417/478 |
| 5,429,485 | 7/1995 | Dodge | 417/478 X |

FOREIGN PATENT DOCUMENTS

| | | | |
|---|---|---|---|
| 2640698 | 6/1990 | France | 417/474 |
| 3143437 | 4/1985 | Germany | 417/510 |

*Primary Examiner*—Richard E. Gluck
*Attorney, Agent, or Firm*—Mark G. Bocchetti; Charles E. Snee, III

[57] ABSTRACT

A multiple-chamber pump (10, 52, 78) for dispensing precise volumes of fluids. The pump is especially suited for dispensing volumes in the microliter range. At least three chambers (18, 20, 22) comprising preferably spherical segments are sequentially connected by conduits (24, 26, 28, 30) and are closed by a diaphragm member (14) which is movable into or out of the chambers by application of pressure or vacuum on one side of the diaphragm to draw liquid into the chambers and then to expel the liquid from the chambers, either forward or backward according to an operating sequence. Control means are provided for alternating and sequencing the application of pressure and vacuum such that metered volumes of liquid (50) are pumped from chamber to chamber. Tiny, precisely controlled drops of liquid can be dispensed. A plurality of ganged pumps (94) also can be provided in a single pump body (96) to meter independently a plurality of fluids (100, 102, 104) simultaneously. Advantageously, flows can be joined (98) or split (118) between ganged pumps to provide precise combinations of different fluids. Flows in any of the preferred pump configurations can be dispensed to one or a plurality of dispensing destinations.

2 Claims, 8 Drawing Sheets

MICRO DISPENSING POSITIVE DISPLACEMENT PUMP

DESCRIPTION

Field of the Invention

The invention concerns apparatus and methods for dispensing fluids, particularly for dispensing discrete quantities of liquids, and most particularly for highly precise dispensing of very small amounts of liquids. The apparatus and methods of the invention are especially useful in dispensing volumes in the microliter range of, for example, blood serum for clinical analysis and adhesives in electronic component assembly.

Background of the Invention

Positive displacement pumps have been used for many years to provide metered amounts of fluid materials, commonly liquids. In general, such a pump functions by drawing liquid from a source through a supply conduit into a metering chamber of known volume, the chamber also having a closeable outlet conduit; closing the supply conduit; opening the outlet conduit; and decreasing the volume of the metering chamber to substantially zero to force the metered volume of liquid through the outlet conduit and out of the pump. The metering chamber can be, for example, a cylinder and the means for drawing liquid into the cylinder and forcing liquid out of the cylinder can be a reciprocating piston operating within the cylinder. A four-stroke internal combustion engine is a form of such a pump, using this approach to draw combustible mixture into the cylinder on the first stroke and to expel exhaust gases from the cylinder on the fourth stroke. A conventional air compressor is also an example of such a pump. Both these pumps require auxiliary intake and exhaust valves to perform their functions.

Another common type of metering pump is a diaphragm pump, in which the metering chamber is typically a spherical recess in a pump body. The recess is provided with inlet and outlet conduits to the exterior of the pump body, and a resilient diaphragm is disposed across and closes the recess. Liquid is drawn into the recess by withdrawing the diaphragm from a position conformal with the wall of the recess, typically by applying vacuum to the side of the diaphragm opposite the recess. This type of pump also requires separate inlet and exhaust valves to perform its function. The inlet is closed by, for example, a check valve, thereby capturing a metered amount of liquid within the recess. The metered volume of liquid then is forced from the recess through an open outlet valve, such as another check valve, by instead applying pressure to the diaphragm to drive the diaphragm into the recess. An automotive engine fuel pump is an example of a single-recess diaphragm pump. Similar pumps are disclosed in U.S. Pat. Nos. 2,980,032 issued Apr. 8, 1961 to Schneider; 3,007,416 issued Nov. 7, 1961 to Childs; 3,250,224 issued May 10, 1966 to Phillips et al.; 4,303,376 issued Dec. 1, 1981 to Siekmann; and 4,983,102 issued Jan. 3, 1991 to Swain.

Single-chamber positive displacement pumps are capable of high precision in metering or dispensing discrete volumes of gases or liquids. Flow of material through these pumps is substantially unidirectional from the liquid source to the dispensing orifice. Known pumps can be subject to metering error as the diaphragm material ages or becomes progressively more distorted from use and thus has a variable displacement volume through its cycle.

In some dispensing applications, the above-described pump cannot meet all the requirements of the application. When the inlet valve is a check valve, a slight reverse flow of liquid from the metering recess is required to close the valve, decreasing by some amount the actual volume available to be dispensed and causing a systematic error in metering. This accuracy error can vary depending upon theological parameters such as viscosity of the liquid. Thus a given pump may dispense differing volumes of liquids having different viscosities. Use of a non-displacement type of inlet valve, such as a rotary valve, can prevent this problem but at significantly increased complexity and expense.

In some micro-metering applications, it is a requirement that the apparatus generate a tiny droplet of liquid of highly precise volume at a dispensing tip. Precisely metered droplets of, for example, 0.5 μl to 1000 μl (1 ml) in volume are commonly required for diagnostic or adhesive applications. The droplet may then be "touched off" on a substrate, following which the column of liquid in the discharge conduit desirably is retracted some distance from the tip. This requires substantial and precise reverse flow in the discharge conduit, of which known diaphragm pumps are incapable.

In some applications, a production line must meter different liquids on successive runs, with no cross-contamination between runs. Metering pumps can be difficult to clean by flushing and can require disassembly, changeout, or discard to prevent contamination. Known pumps can be difficult and time-consuming to disassemble and expensive to discard. Changeout, with off-line cleaning, can also reduce runtime efficiency.

In some applications, it is desirable to have a plurality of highly precise micro-droplets of one or several liquids, and of the same or different sizes, produced in close proximity to each other. Known micro-dispensing pumps, when adapted to provide reverse flow as discussed hereinabove, can be cumbersome and expensive in such configuration.

In some applications, it is desirable to divide liquid flow from a single source into a plurality of metered dispenses. It can also be desirable to combine liquid flows from a plurality of sources into a single metered dispense. It can also be desirable to meter and combine liquid flows from a plurality of sources and to direct the metered combined liquid to one or more dispense orifices. These applications of known apparatus can require very complex valving, tubing, and control assemblies.

It is a principal object of the invention to provide improved apparatus for precisely dispensing microliter amounts of liquid.

It is a further object of the invention to provide improved methods for precisely dispensing microliter amounts of liquid.

It is a still further object of the invention to provide improved dispensing apparatus which agitates a liquid in a source supplying the apparatus.

It is a still further object of the invention to provide improved dispensing apparatus which withdraws undispensed liquid from its dispensing orifice.

It is a still further object of the invention to provide improved dispensing apparatus which can be economically manufactured, easily cleaned, and economically discarded after use if desired.

It is a still further object of the invention to provide improved dispensing apparatus which can include in a single support member a plurality of precise microliter metering pumps.

It is a still further object of the invention to provide improved dispensing apparatus which can combine metered microliter amounts of a plurality of liquids and precisely dispense the combination to one or a plurality of dispensing orifices.

It is a still further object of the invention to provide improved dispensing apparatus which can meter microliter amounts of liquid to a plurality of dispensing orifices.

It is a still further object of the invention to provide improved dispensing apparatus in which the dispensed volume does not vary with age or use of the apparatus.

SUMMARY OF THE INVENTION

Briefly described, the apparatus of the invention comprises at least three interconnected variable-volume chambers whose volume can be varied according to a sequence whereby precisely metered amounts of liquid, especially very small amounts in the microliter range, are withdrawn from a source and dispensed through a dispensing orifice, while the liquid in the source is automatically agitated and non-dispensed liquid is withdrawn from a dispensing orifice after each dispensation.

A chamber, such as a cylinder or a spherical recess, in a support member is closed by an actuable closing member, for example, a reciprocable piston or a flexible diaphragm which is actuable to decrease or increase the volume of the chamber between a maximum volume, generally equal to the volume of fluid to be metered, and a minimum volume, generally substantially zero. The metering chamber is provided with an inlet conduit leading from a source of liquid to be metered. When the closing member is driven to one extreme, the metering chamber is opened to its metering volume and draws in liquid from the source to fill the metering chamber. When driven to the opposite extreme, the closing member expresses the metered volume of liquid from the metering chamber and also closes both the inlet and the outlet conduits in the manner of a valve.

Between the source and the metering chamber, the inlet conduit passes through an inlet chamber similar to the metering chamber and equipped with an independently actuable closing member such as a piston or diaphragm, as appropriate, to vary the volume of the inlet chamber. When driven to one extreme position, the closing member opens the inlet chamber to its largest volume and draws in liquid from the source to fill the inlet chamber. When driven to an opposite extreme position, the closing member closes the inlet conduit, in the manner of a valve, between the metering chamber and the inlet chamber and also returns fluid in the inlet chamber to the source, thereby preventing stagnation or stratification of liquid in the source.

The metering chamber is provided with an outlet conduit leading to a dispensing orifice. Between the metering chamber and the dispensing orifice, the outlet conduit passes through an outlet chamber similar to the metering chamber at least as large as the metering chamber, and preferably larger, and equipped with an independently actuable closing member such as a piston or diaphragm, as appropriate, to vary the volume of the outlet chamber. When driven to one extreme position, the closing member opens the outlet chamber to its fullest volume to withdraw previously expressed liquid or air in the outlet conduit from between the outlet chamber and the dispensing orifice and to accept the next metered volume of liquid from the metering chamber. When driven to an opposite extreme position, The closing member closes the outlet conduit in the manner of a valve between the metering chamber and the outlet chamber, and expresses fluid in the outlet chamber toward the dispensing orifice.

At startup, it may be desirable to cycle the apparatus several times to prime the inlet chamber and to purge air from all conduits. In a preferred sequence of operation after the pump has been purged of air, the dispensing cycle begins with all chambers closed. First, the inlet chamber is opened, filling it with liquid. Second, the metering chamber is opened, filling it also with liquid and thereby defining the volume to be metered. Third, the inlet chamber is closed, forcing liquid back into the source reservoir, thereby agitating the liquid therein, and closing off the entrance to the metering chamber. Fourth, the outlet chamber is opened, filling it with previously-metered liquid or air in reverse flow through the outlet conduit between the outlet chamber and the dispensing orifice. Fifth, the metering chamber is closed, expressing a metered volume of liquid into the outlet chamber and displacing an equal volume of previously-metered liquid or air toward the dispensing orifice, and closing the conduit from the metering chamber to the outlet chamber. Sixth, the outlet chamber is closed, dispensing from the dispensing orifice a volume of liquid exactly equal to the volume of the metering chamber, closing the conduit between the metering chamber and the outlet chamber, and returning the apparatus to the starting configuration with all chambers closed. A net amount of one volume of the metering chamber has been dispensed from the dispensing orifice.

In another embodiment, the invention can provide a combined metered flow from a plurality of independent sources. Each source requires an inlet chamber and a metering chamber as described hereinabove. The metering chambers can be of differing volumes and are all connected to a common outlet chamber which has a greater volume than the combined volumes of the metering chambers. Operation is as above, to dispense the combined liquids in an exactly metered total volume having a highly precise composition.

The embodiment just described can be provided with a plurality of outlet conduits from the single outlet chamber leading to a plurality of dispensing orifices. Flows to the various dispensing orifices can be modulated as desired by altering the diameter and length of the various outlet conduits.

BRIEF DESCRIPTION OF THE DRAWINGS

The foregoing and other objectives, features, and advantages of the invention will be apparent from the following more particular description, including the presently preferred embodiment of the invention, as illustrated in the accompanying drawings in which.

DETAILED DESCRIPTION OF THE INVENTION

Figure 1:
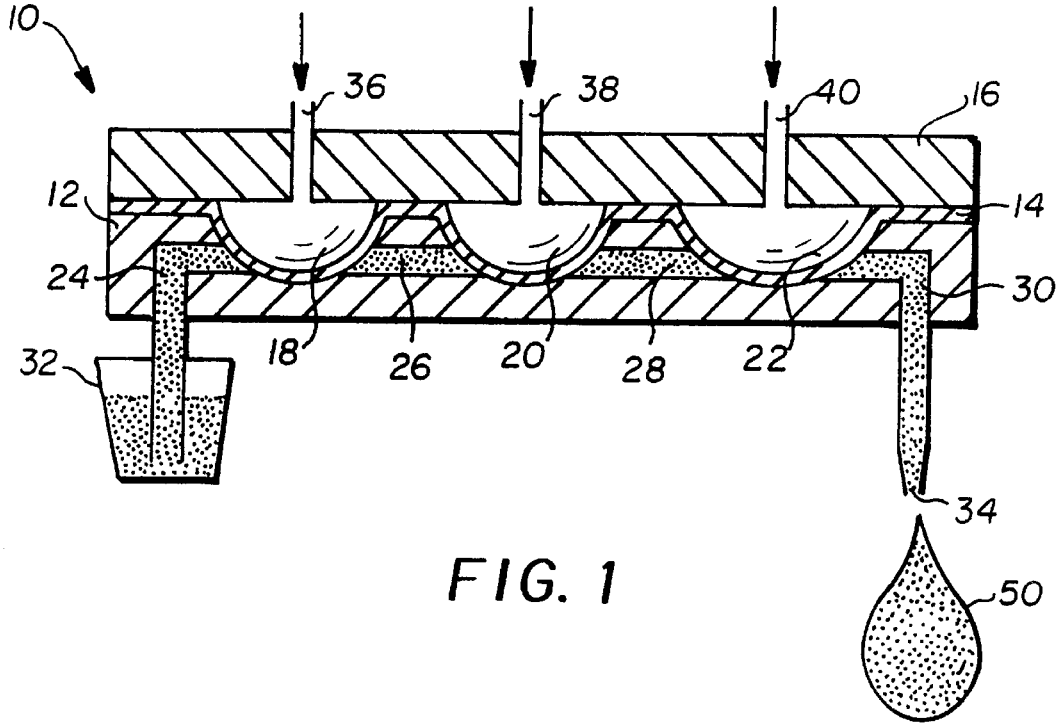
FIG. 1 is a cross-sectional view of a diaphragm metering pump in accordance with the invention at the starting point of a dispense cycle, having completed a cycle and dispensed a metered amount of liquid.

Referring to FIGS. 1 through 6, a diaphragm metering pump 10 includes a support member (pump body) 12, a diaphragm 14, and a pressure/vacuum plate 16. Pump body 12 is provided with an inlet recess 18, a metering recess 20, and an outlet recess 22, each recess being preferably a shallow spherical section. The recesses communicate with each other and with the exterior of pump body 12 by means of inlet conduit 24, metering inlet conduit 26, metering outlet conduit 28, and dispensing conduit 30. Supply vessel 32 contains a supply of liquid to be metered, the upstream end of inlet conduit 24 being immersed in the liquid at all times to avoid entrainment of air into the pump. Dispensing conduit 30 may be provided with a narrow-diameter dispensing tip 34. Plate 16 is provided with pressure/vacuum conduits 36, 38, and 40, by means of which air pressure or vacuum alternately can be applied (by means not shown) to diaphragm 14 where it overlies and closes recesses 18, 20, and 22, respectively. Plate 16 and pump body 12 hold diaphragm 14 compressibly therebetween by known clamping means (not shown).

Figure 9:
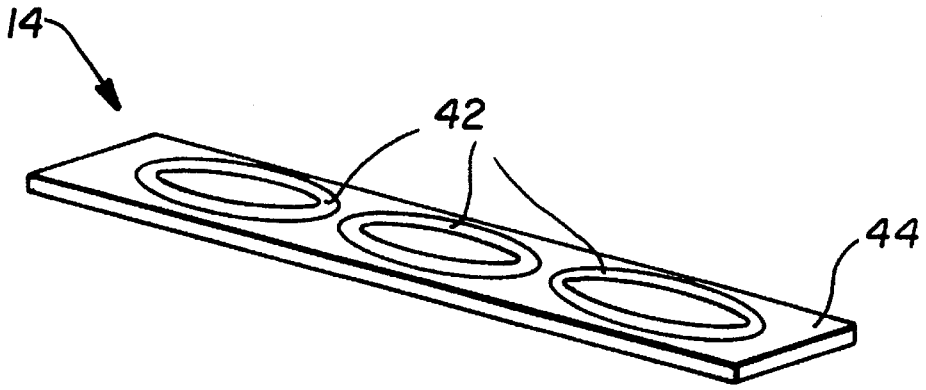
FIG. 9 is an isometric view of the diaphragm shown in FIG. 7, showing preferred O-rings cast in the upper surface of the diaphragm which mate with the relieved porting in the air-vacuum plate as shown in FIG. 8.

Pump body 12 can be formed from a wide variety of materials. Metals such as stainless steel and titanium are easily machined to great accuracy. Various plastics are suitable, and in a preferred embodiment the pump body with its recesses and conduits is injection molded from a thermoplastic resin, yielding a pump body of very high precision at very low cost. It is an important advantage of the invention that these pumps can be manufactured to very high tolerances to deliver precisely very small volumes but at a cost low enough to permit the pumps to be economically discarded after use. (The precision demands on machining or molding the recesses are extremely high. A spherical metering recess intended to meter a volume of 1.0 μl can have an opening diameter of 2.4355 mm and a depth of 0.4135 mm. Tolerances in machining or molding of ±0.0365 mm in the diameter and ±0.0075 mm in the depth will result in recess volumes of between 0.9 and 1.1 μl.) Plate 16 also can be easily formed by injection molding. Diaphragm 14 can be formed from a wide variety of elastomers, or if the recesses are shallow the diaphragms can be biased flexible discs formed from plastic or metal which can spring between open and closed positions. In some applications, this may require only pressure or vacuum to drive the diaphragm to a closed or open position and may obviate the need for pressure or vacuum to close or open the recesses. In a preferred embodiment, diaphragm 14 is a continuous sheet of silicone elastomer which is provided by molding with raised "O-ring" features 42 on the side 44 facing the pressure/vacuum plate 16, as shown in FIG. 9. The areas within features 42 define the active areas of diaphragm 14. Plate 16 is provided with a plurality of annular grooves 46 which mate with O-rings 42 to position the diaphragm correctly and to seal the edges of the pressure/vacuum region above the active areas. Within annular grooves 46 are radial passages 48 relieved in the surface of 16 and communicating with pressure/vacuum conduits 36, 38, and 40. Passages 48 permit vacuum to be applied uniformly over the surfaces of the active diaphragm areas, thereby causing the diaphragm to be drawn flat against plate 16 when the recesses are fully open. This assures a high degree of precision in dispensing and also allows the pump to actually deliver the calculated volume of the metering recess. For example, a pump in accordance with the invention having a spherical metering recess with a nominal volume of 900 μl was cycled through 35 consecutive dispensations. The average dispense volume was 900.29 μl, standard deviation was 0.62 μl, and the coefficient of variance was 0.069%. The pump also can be very precise regardless of distortions in the diaphragm caused by repeated cycling, since the diaphragm is actively drawn flat against a stop (plate 16) on the chamber-opening stroke and is driven conformably against another stop (recess 18, 20, or 22) on the chamber-closing stroke.

Inlet conduit 24 has no strict requirements as to size and length, other than that it must not entrain air and it must be sufficiently stiff to avoid collapsing under suction during filling of the inlet and metering recesses.

Outlet conduit 26 has the same requirements as inlet conduit 24, but in addition it preferably has a volume between outlet recess 22 and dispensing tip 34 greater than the volume of outlet recess 22. This prevents air from reaching recess 22 when it is opened and also prevents liquid from reaching tip 34 when the metered volume of liquid to be dispensed is expressed from metering recess 20 into outlet recess 22.

At startup, preferably the pump is run through several dispense cycles to allow liquid to purge the conduits and recesses of air. Particularly in miniature embodiments such as those intended to dispense microliter amounts, the air volumes are so small, and the minimum size stable bubble is so large relative to the passages in the pump, that all air is expelled in the first one or two cycles. Larger pumps may require further purging, and pumps intended to dispense, for example, liter amounts may benefit from being operated in a position inverted from that shown in FIGS. 1 through 6.

Embodiments within the scope of the invention also may utilize hydraulic means or mechanical means to cause the volume of the pump chambers to be varied during operation of the pump.

In operation, pump 10 proceeds through six stages in a preferred sequence of recess openings and closings as described briefly hereinabove. The first stage, shown in FIG. 1, is also a seventh stage of the preceding cycle. A metered drop 50 of liquid has been expressed from dispensing tip 34 in a preceding cycle by the closing of outlet recess 22 by air pressure 52 exerted through conduit 40. (Preferably, air pressure in the range of $1.4\times10^5$Pa has been found sufficient to actuate the diaphragms of pump 10 quickly and precisely.) All recesses are closed in FIG. 1 and all conduits are filled with liquid in preparation for the next dispense cycle.

Figure 2:
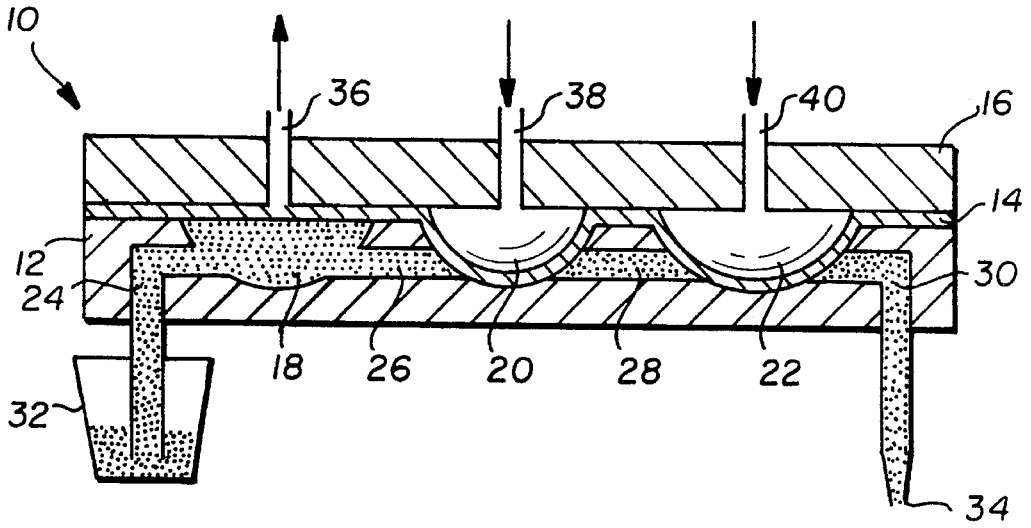
FIG. 2 is a view like FIG. 1, showing the pump at the second stage in a dispense cycle, having opened and filled the inlet chamber with liquid from a source.
Figure 3:
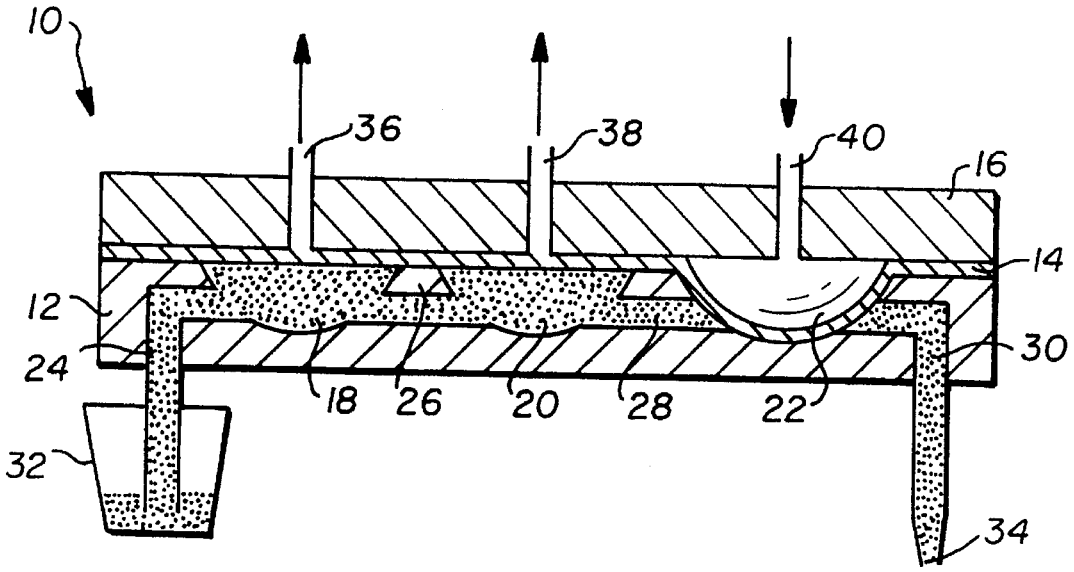
FIG. 3 is a view like FIG. 1, showing the pump at the third stage in a dispense cycle, having opened and filled the metering chamber with liquid from a source.
Figure 4:
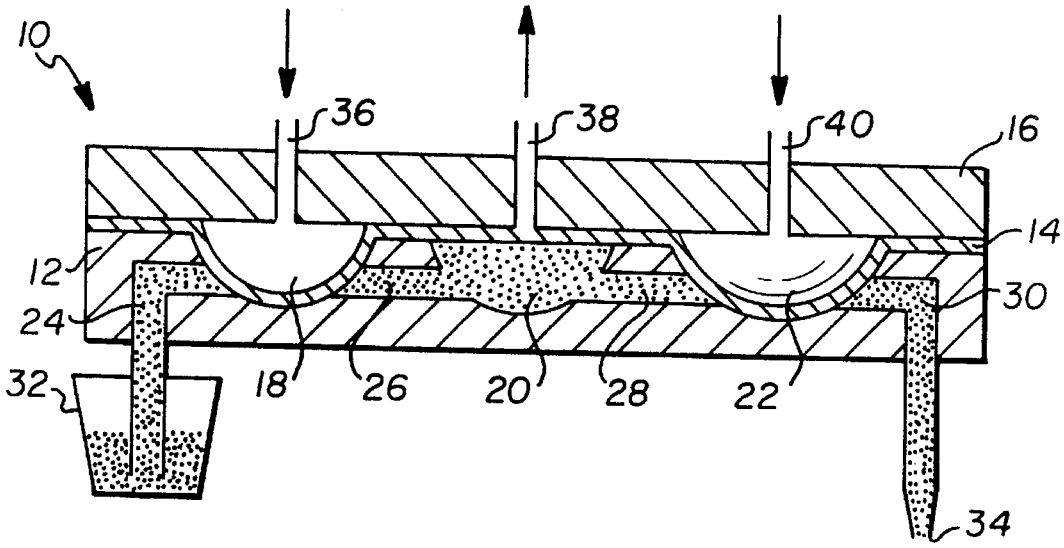
FIG. 4 is a view like FIG. 1, showing the pump at the fourth stage in a dispense cycle, having closed and emptied the inlet chamber, returned liquid to the source and agitated the liquid in the source, and closed the inlet conduit to the metering chamber.
Figure 5:
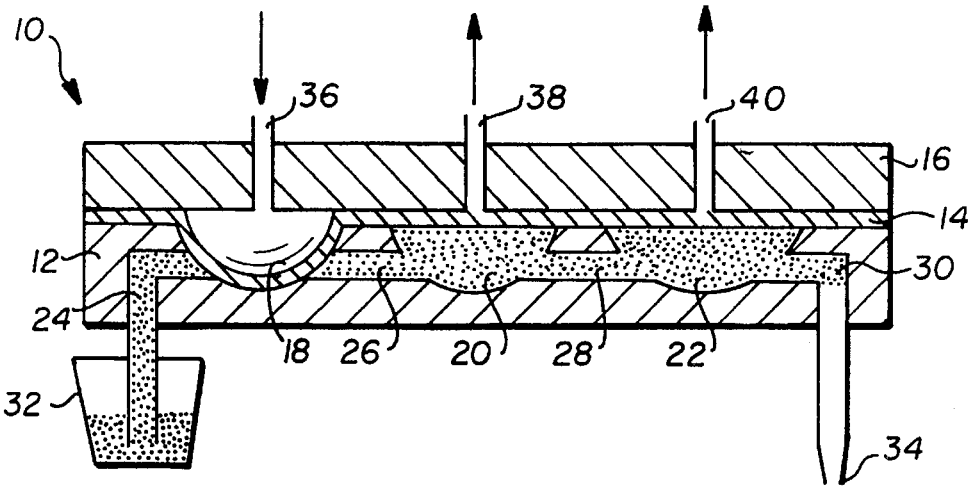
FIG. 5 is a view like FIG. 1, showing the pump at the fifth stage in a dispense cycle, having opened and filled the outlet chamber with non-dispensed liquid by reverse flow from the outlet conduit.
Figure 6:
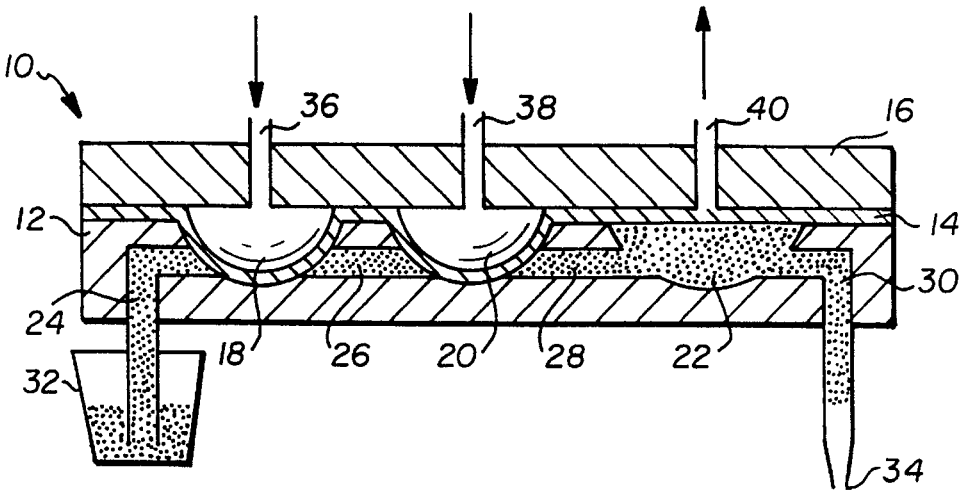
FIG. 6 is a view like FIG. 1, showing the pump at the sixth stage in a dispense cycle, having closed and emptied the metering chamber and expressed the metered volume of liquid into the outlet chamber in preparation for closing the outlet chamber and dispensing the metered volume as shown in FIG. 1.

The cycle begins (second stage) with the opening of inlet recess 18 by applying vacuum to diaphragm 14 through conduit 36 (by conventional means not shown). A negative pressure in the range of $0.7\times10^5$Pa is preferred. Liquid is drawn into inlet recess 18 through inlet conduit 24 and fills recess 18, as shown in FIG. 2. In the third stage, metering recess 20 is opened by applying vacuum to diaphragm 14 through conduit 38. This pulls the diaphragm flat against plate 16, filling recess 20 with a metered amount of liquid through inlet conduit 24 and inlet recess 18, as shown in FIG. 3. In the fourth stage, inlet recess 18 is closed by applying pressure through conduit 36. This drives the diaphragm tightly against the curved surface of recess 18, which closes metering inlet conduit 26 and also returns the liquid in recess 18 to supply vessel 32, as shown in FIG. 4. The flow of returning liquid in each dispense cycle keeps the supply liquid from stagnating or settling, a very important requirement in some applications. In the fifth stage, outlet recess 22 is opened by applying vacuum through conduit 40. Since the supply inlet to recess 22 is deadheaded by the closing of inlet recess 18, recess 22 fills by returning non-dispensed liquid through dispensing conduit 30, as shown in FIG. 5. As noted previously, it is preferable that the volume of conduit 30 be larger than the volume of recess 22. For many applications, exactly how much larger is unimportant. Since outlet recess 22 is preferably at least as large as, or larger than, metering recess 20, when a metered volume of liquid is expressed from recess 20 into recess 22 in the subsequent sixth stage, a volume of liquid equal to the volume of recess 20 is forced into dispensing conduit 30 toward tip 34. A tidal volume of air 52 equal to the volume difference between recesses 22 and 20 remains in conduit 30 between the expressed liquid and the tip, as shown in FIG. 6. When recess 22 is closed as shown in FIG. 1, completing the cycle, air volume 52 is dispensed from tip 34 followed by an amount of liquid equal to the volume of metering recess 20. This results in a slight temporal delay between the beginning of closing of recess 22 and the onset of formation of drop 50. If a delay is undesirable it can be eliminated by sizing the length and diameter of dispensing conduit 30 such that the combined volume of conduit 28, recess 22, and conduit 30 is an integral multiple of the volume of metering recess 20.

Figure 7:
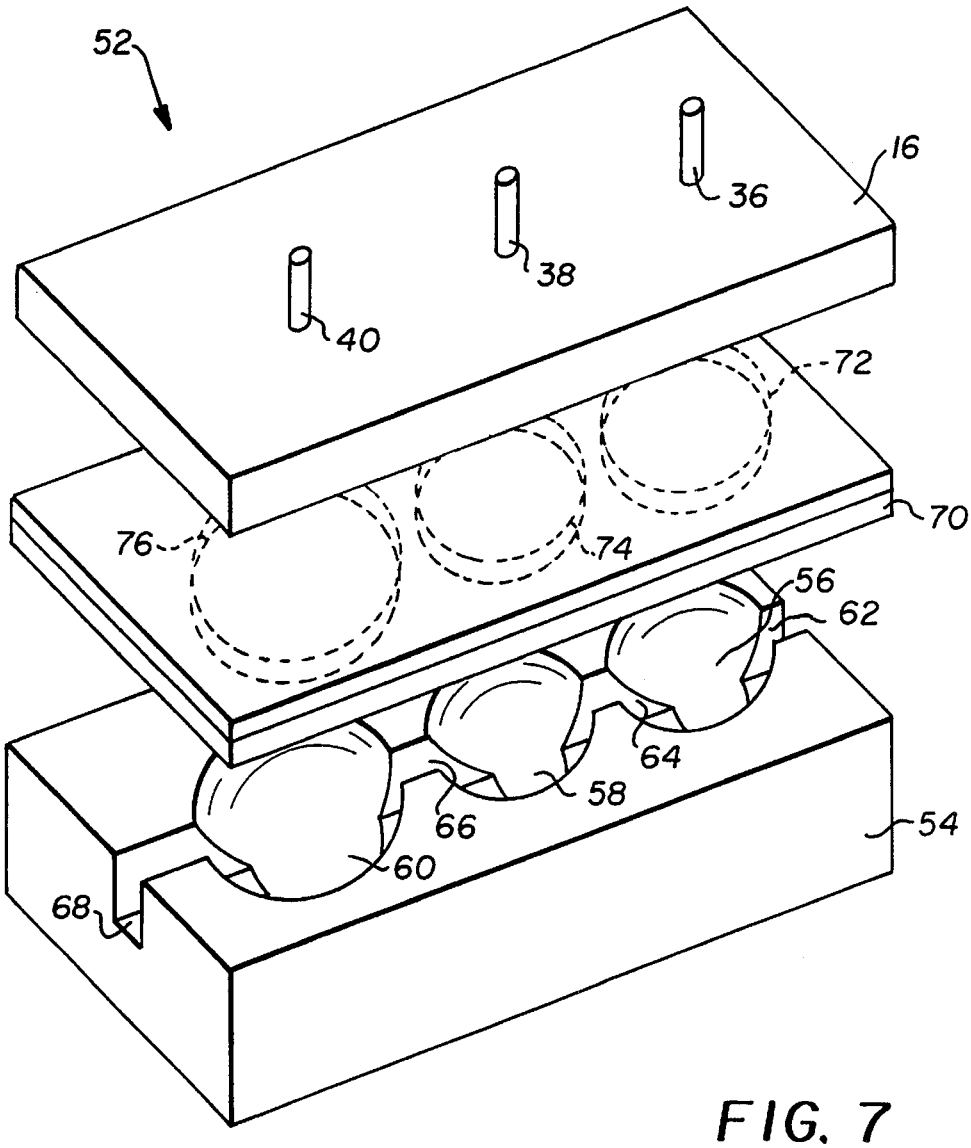
FIG. 7 is an exploded isometric view of a diaphragm metering pump in accordance with the invention, showing an alternative configuration of conduits and a pressure-shielding plate between the diaphragm and the pump body to prevent the diaphragm from being pressed into the conduits.
Figure 8:
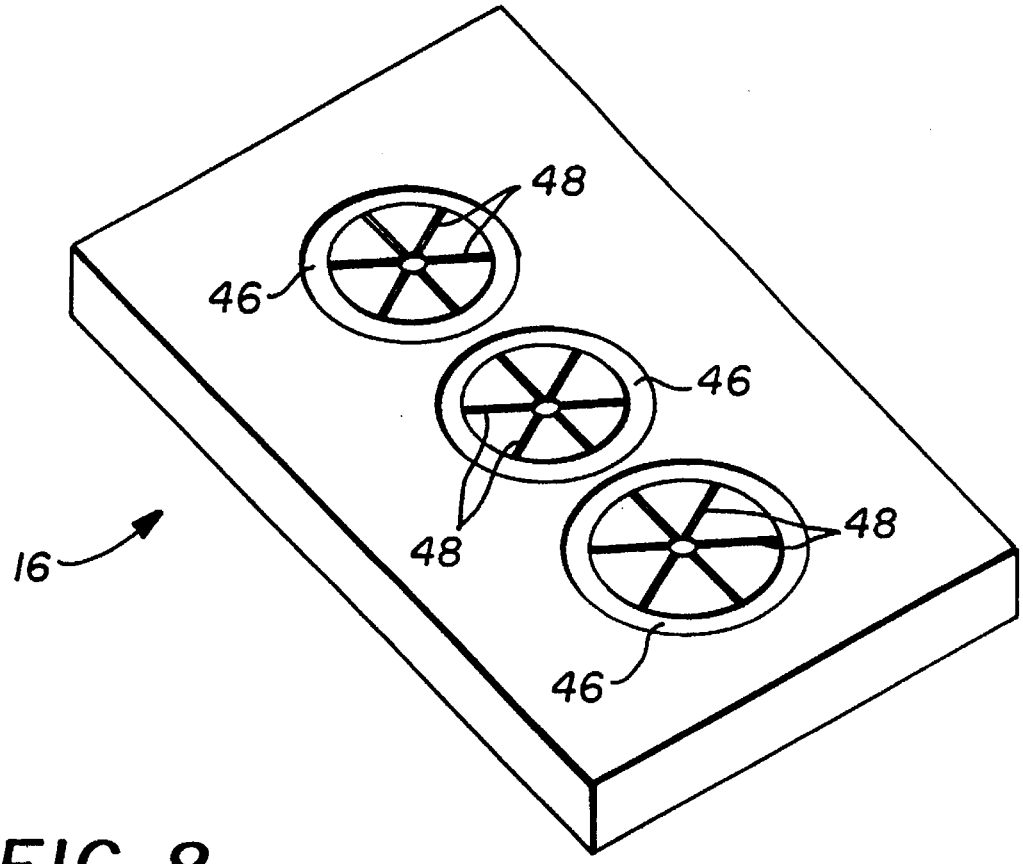
FIG. 8 is an isometric view of the underside of the air/vacuum plate shown in FIG. 7, showing preferred relieved porting of the plate surface to provide distribution of pressurized air and/or vacuum over the surface of the diaphragm.

An alternative embodiment 52 of a pump according to the invention is shown in FIG. 7. Recesses 56, 58, and 60 are analogous to recesses 18, 20, and 22, respectively. Instead of having conduits contained wholly within the pump body as in the embodiment of FIGS. 1 through 6, conduits can be provided as channels which can readily be molded or cut into the surface of pump body 54. Channels 62, 64, 66, and 68 are analogous to conduits 24, 26, 28, and 30, respectively. (For simplicity of presentation, a liquid supply and a dispensing tip have been omitted from FIG. 7.) Because these channels can be cut in a single pass of a cutting tool, pump body 54 can be produced inexpensively. Further, this technique affords great flexibility is designing ganged or multiple-flow pumps as described hereinbelow.

Pumps of this type are also easily cleaned. In some applications, the pump can be cleaned and returned to service simply by opening the pump, brushing or flushing the recesses and channels which are all available on the pump body surface, discarding and replacing the used diaphragm, and closing the pump.

Because the diaphragm is unsupported by the pump body over the channels, a pressure-shielding plate 70 may be required between diaphragm 14 and plate 16 to prevent leakage between recesses or fatigue of the diaphragm. Plate 70 has apertures 72, 74, and 76 substantially the size of recesses 56, 58, and 60, respectively, which apertures function as extensions of the recesses. The diaphragm acts through the apertures and is prevented thereby from being deformed into the channels.

Figure 10:
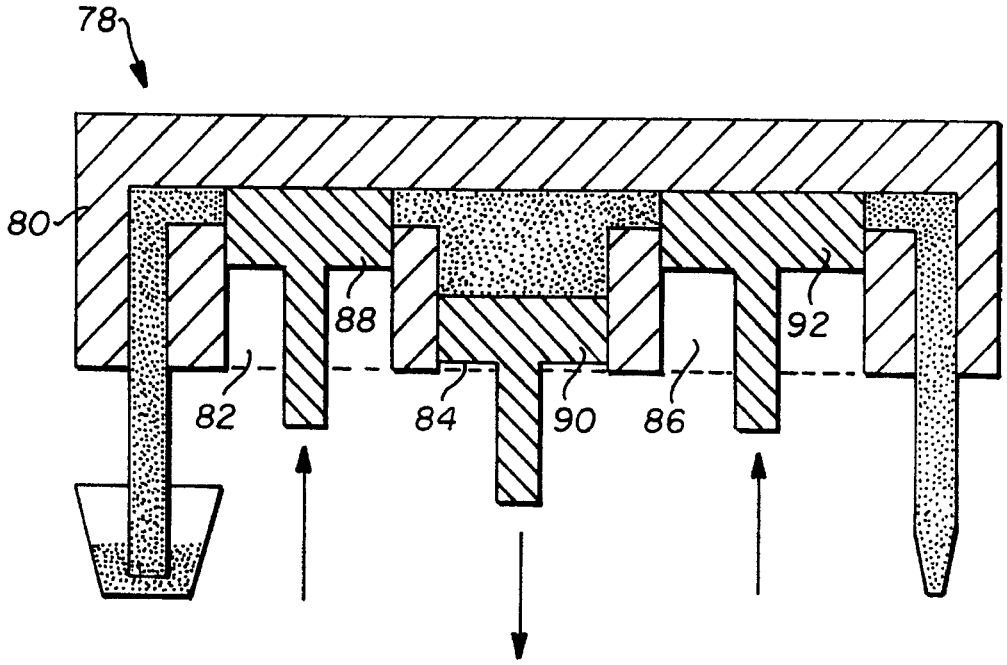
FIG. 10 is a cylinder-and-piston embodiment of a metering pump in accordance with the invention, shown at the same stage in a dispense cycle as the diaphragm pump shown in FIG. 4.

Another embodiment 78 of a metering pump in accordance with the invention is shown in FIG. 10. Pump body 80 is provided with cylinders 82, 84, and 86 which are analogous to recesses 18, 20, and 22, respectively, in the embodiment of FIGS. 1 through 6. Pistons 88, 90, and 92 are reciprocally operative within the cylinders and are analogous to diaphragm 14. The operation of pump 78 is identical with that of pumps 10 and 52. The pump in FIG. 10 is shown at the same stage in the dispense cycle as is the pump in FIG. 4, previously discussed. Such a pump can be acceptable for many applications, but for dispensing shear-sensitive liquids such as some lattices a diaphragm embodiment can be preferable.

Multiple-flow pumps of great versatility can easily be provided in accordance with the invention. Some applications, for example, assembly of CD read heads, require that a plurality of metered microliter amounts of liquids, such as radiation-curable adhesives, be dispensed simultaneously and in close proximity to each other. A ganged pump 94, as is shown schematically in FIG. 11, can use the technology shown in the single pump 52 in FIG. 7. A pump body 96 is provided with three independent sets of inlet, metering, and outlet recesses, preferably in a single surface thereof. The recesses in each set are connected by channels as in pump 52. A pressure-shielding plate and pressure/vacuum plate (not shown) are provided as for pump 52. The three metering recesses in ganged pump 94 can be the same or different sizes to provide the same or different metered amounts of liquid.

Figure 12:
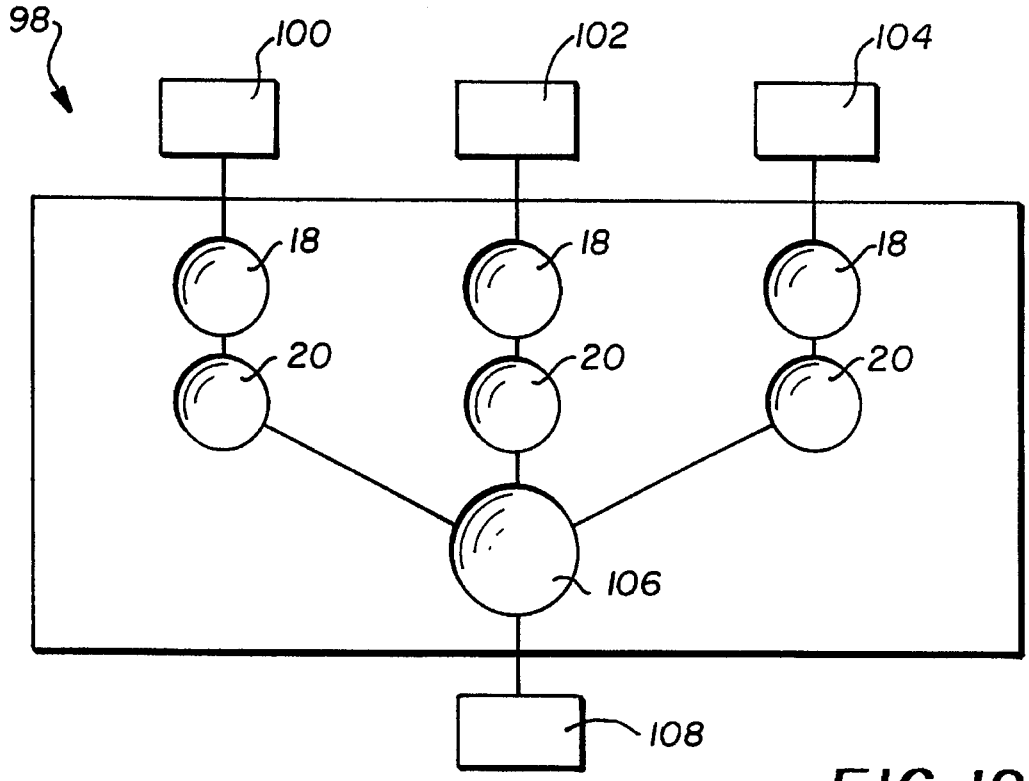
FIG. 12 is a schematic plan view similar to that of FIG. 11, showing a multiple-pump apparatus which can meter liquids from three separate sources, combine the liquids, and dispense the combined metered liquids to a single dispensing destination.

A multiple-flow pump 98 can be easily fabricated by the technology shown for pumps 94 and 52 to meter a plurality of liquids from sources 100, 102, and 104 into combination in a common outlet recess 106 and to dispense the combined liquids to a single dispensing destination 108, as shown in FIG. 12. Conversely, liquid from a single source 110 can be metered and then dispensed to a plurality of dispensing destinations 112, 114, and 116, as shown in embodiment 118 in FIG. 13. The principles in embodiments 98 and 118 can be combined to provide a pump 120, shown in FIG. 14, which can meter independent amounts of liquid from independent sources 122, 124, and 126, combine the metered amounts in a common outlet recess 128, and dispense the combined liquids to a plurality of independent dispensing destinations 130, 132, and 134.

From the foregoing description, it will be apparent that there has been provided improved apparatus and methods for precise and inexpensive metering of amounts of liquid, particularly for amounts in the microliter range, and particularly for simultaneous multiple flows and combinations of microliter amounts of different liquids. Variations and modifications in the herein described apparatus and methods, within the scope of the invention, will undoubtedly suggest themselves to those skilled in the art. Accordingly, the foregoing description should be taken as illustrative and not in the limiting sense.

PARTS LIST

Figure 11:
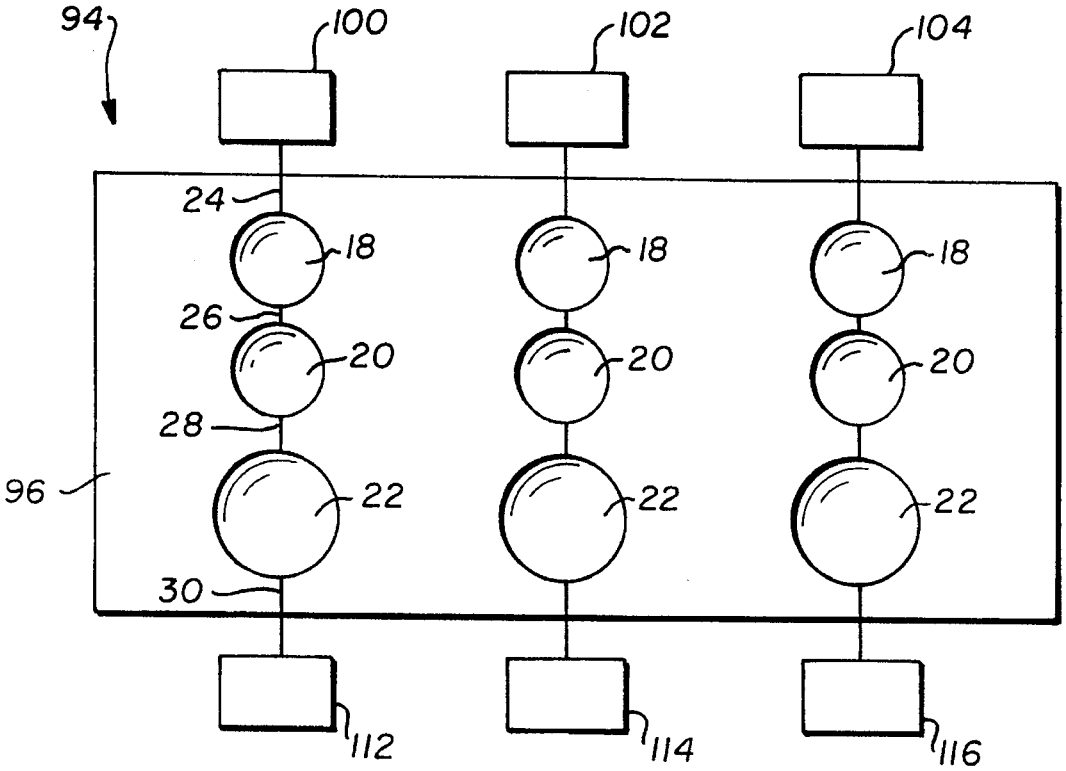
FIG. 11 is a schematic plan view of a multiple-pump apparatus in accordance with the invention, which can dispense simultaneously three separate metered amounts from three separate sources of liquids to three separate dispensing destinations.
Figure 13:
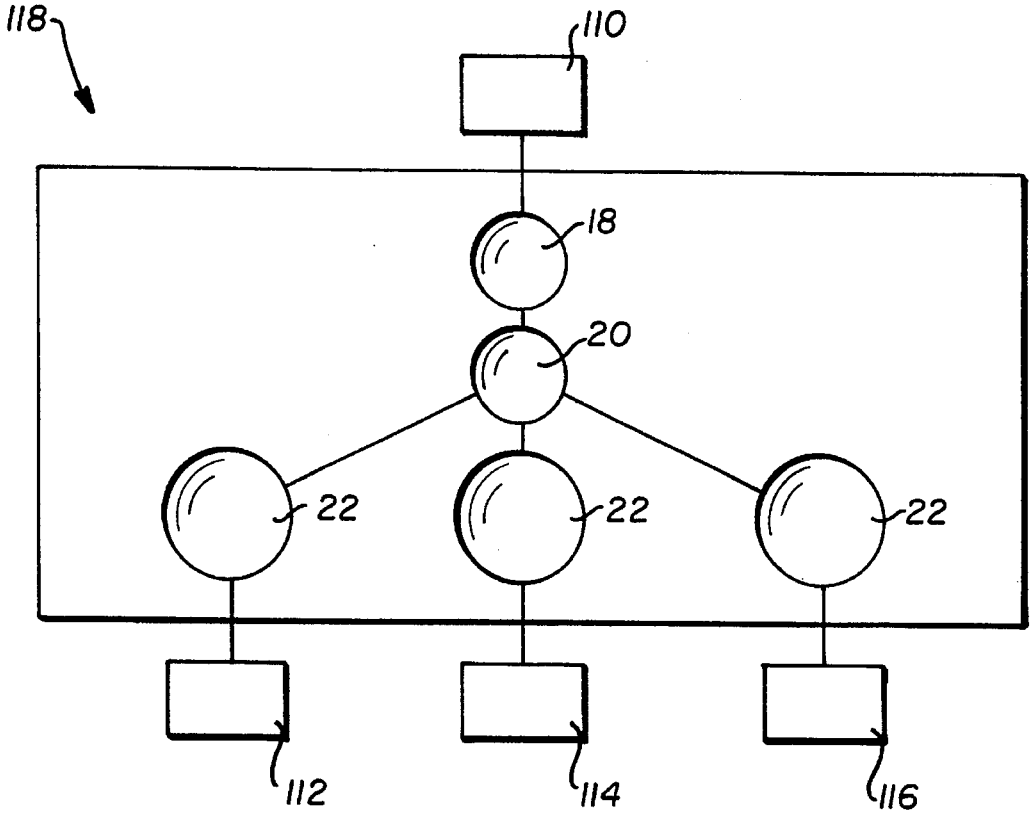
FIG. 13 is a schematic plan view similar to that of FIG. 11, showing a multiple-pump apparatus which can meter a liquid from a single source to three separate dispensing destinations.
Figure 14:
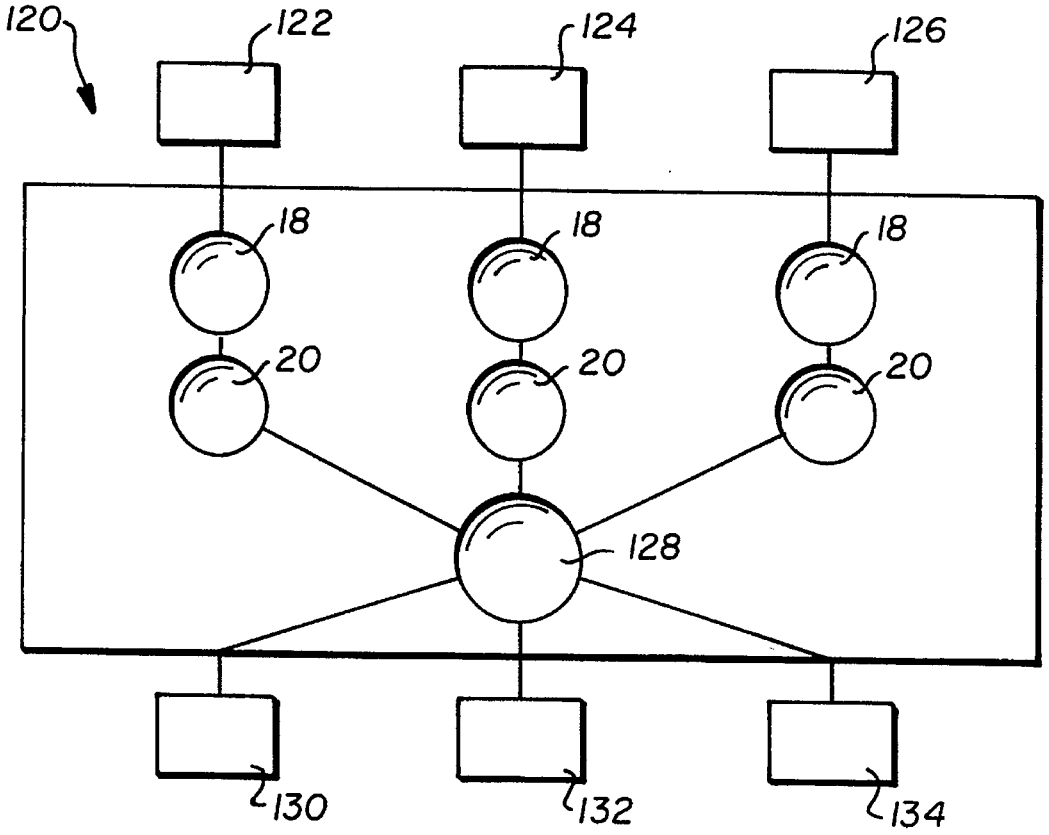
FIG. 14 is a schematic plan view similar to that of FIG. 12, showing a multiple-pump apparatus which can meter liquids from three separate sources, combine the liquids, and dispense the combined metered liquids to three separate dispensing destinations.

10 diaphragm metering pump
12 support member or pump body for 10
14 diaphragm for 10
16 pressure/vacuum plate for 10
18 inlet recess in 12
20 metering recess in 12
22 outlet recess in 12
24 inlet conduit in 12
26 metering inlet conduit in 12
28 metering outlet conduit in 12
30 dispensing conduit in 12
32 supply vessel for 24
34 dispensing tip on 30
36 pressure/vacuum conduit for 18
38 pressure/vacuum conduit for 20
40 pressure/vacuum conduit for 22
42 molded O-rings on 14
44 surface of 14 facing 16
46 annular grooves in 16
48 radial passages in 16
50 metered drop of liquid
52 alternative embodiment in FIG. 7
54 pump body of 52
56 inlet recess in 54
58 metering recess in 54
60 outlet recess in 54
62 inlet channel in 54
64 metering inlet channel in 54
66 metering outlet channel in 54
68 dispensing channel in 54
70 pressure-shielding plate in 52
72 aperture in 70 over 56
74 aperture in 70 over 58
76 aperture in 70 over 60
78 embodiment in FIG. 10
80 pump body in 78
82 inlet cylinder in 80
84 metering cylinder in 80
86 dispensing cylinder in 80
88 piston in 82
90 piston in 84
92 piston in 86
94 ganged pump in FIG. 11
96 pump body in 94
98 ganged pump in FIG. 12
100 first liquid source to 98
102 second liquid source to 98
104 third liquid source to 98
106 common outlet recess in 98
108 single dispensing destination for 98
110 single liquid source to 118
112 first dispensing destination for 118
114 second dispensing destination for 118
116 third dispensing destination for 118
118 embodiment in FIG. 13
120 embodiment in FIG. 14
122 first liquid source for 120
124 second liquid source for 120
126 third liquid source for 120
128 common outlet recess in 120
130 first dispensing destination for 120
132 second dispensing destination for 120
134 third dispensing destination for 120

What is claimed is:

1. Apparatus for intermittently dispensing a plurality of volumes of fluid, comprising;

a) a plurality of sources of fluids to be dispensed;

b) a support member having surfaces and a dispensing orifice in at least one of said surfaces and having a plurality of sets of first and second chambers having first and second volumes, respectively, said first and second volumes being independently and selectively variable, and having a third chamber having a maximum volume larger than the combined volumes of the plurality of second chambers, and having a plurality of first conduits, one to each set of chambers, extending from said sources of fluids to said first chambers, and having a plurality of second conduits, one to each set of chambers, extending from said first chambers to said second chambers, and having a plurality of third conduits, one to each set of chambers, extending from said second chambers to said third chamber to said dispensing orifice;

c) means for selectively increasing said first volumes to draw fluid from respective of said sources through respective of said first conduits into respective of said first chambers;

d) means for selectively increasing said second volumes to draw fluid from respective of said sources through respective of said first conduits and said first chambers and said second conduits into respective of said chambers;

e) means for selectively decreasing said first volumes to return fluid to respective of said sources and to close respective of said second conduits;

f) means for selectively increasing the volume of said third chamber to said maximum volume to withdraw fluid from said fourth conduit;

g) means for selectively decreasing said second volumes to first expel respective of said fluids from said second chambers into said third chamber and thereby combine said second volumes of the respective fluids, and to then close said second and third conduits;

h) means for selectively decreasing said increased third volume to first expel said combined second volumes of fluids from said third chamber through said fourth conduit toward said dispensing orifice and to then close said third conduits.

2. Apparatus according to claim 1 further comprising a plurality of fourth conduits extending from said third chamber to a plurality of dispensing orifices.

* * * * *